US010662614B2

(12) United States Patent
Eckrote

(10) Patent No.: US 10,662,614 B2
(45) Date of Patent: May 26, 2020

(54) VERTICALLY ADJUSTABLE ADAPTOR FOR A WORK VEHICLE IMPLEMENT

(71) Applicant: CNH Industrial America LLC, New Holland, PA (US)

(72) Inventor: Richard Carter Eckrote, Wichita, KS (US)

(73) Assignee: CNH Industrial America LLC, New Holland, PA (US)

( * ) Notice: Subject to any disclaimer, the term of this patent is extended or adjusted under 35 U.S.C. 154(b) by 169 days.

(21) Appl. No.: 15/901,284

(22) Filed: Feb. 21, 2018

(65) Prior Publication Data

US 2019/0257057 A1 Aug. 22, 2019

(51) Int. Cl.

| | |
|---|---|
| ***E02F 3/815*** | (2006.01) |
| ***E02F 3/76*** | (2006.01) |
| ***E02F 3/84*** | (2006.01) |
| ***E02F 3/96*** | (2006.01) |

(52) U.S. Cl.

CPC ..... *E02F 3/7609* (2013.01); *E02F 3/844* (2013.01); *E02F 3/96* (2013.01)

(58) Field of Classification Search

CPC ..... E02F 3/3686; E02F 3/7609; E02F 3/7695; E02F 3/80; E02F 3/84; E02F 3/844; E02F 3/96

USPC ..... 172/810, 811, 817, 828; 414/631

See application file for complete search history.

(56) References Cited

U.S. PATENT DOCUMENTS

| | | | | |
|---|---|---|---|---|
| 4,231,450 | A * | 11/1980 | Hedtke | B66F 17/003 180/282 |
| 4,241,525 | A * | 12/1980 | Mann | E02F 3/8155 172/777 |
| 4,394,107 | A * | 7/1983 | Siebert | B66F 9/06 187/235 |
| 5,098,252 | A * | 3/1992 | Sheesley | E02F 3/3627 172/273 |
| 6,227,792 | B1 | 5/2001 | Baker et al. | |
| 6,510,680 | B2 | 1/2003 | Uhlending et al. | |
| 6,923,508 | B2 * | 8/2005 | Holl | E01C 23/088 299/36.1 |
| 7,472,499 | B2 * | 1/2009 | Schmeichel | E01H 5/06 37/231 |

(Continued)

FOREIGN PATENT DOCUMENTS

EP 2710869 A1 3/2014

*Primary Examiner* — Gary S Hartmann

(74) *Attorney, Agent, or Firm* — Peter Zacharias; Patrick Sheldrake

(57) ABSTRACT

An adaptor configured to move a work vehicle implement includes a work vehicle portion that includes a first receiver interface configured to couple to a work vehicle. The first receiver interface includes at least one receiver locking feature configured to non-movably couple the work vehicle portion to the first connector interface. The adaptor also includes a work implement portion moveably coupled to the work vehicle portion and a second connector interface configured to couple to a second receiver interface of the work vehicle implement. The adaptor also includes a track system comprising a slot disposed within the work vehicle portion and a slider disposed on the work implement portion, wherein the slider is configured to move along the slot, and at least one actuator configured to actuate the work implement portion with respect to the work vehicle portion along a guide path.

10 Claims, 6 Drawing Sheets

(56) References Cited

U.S. PATENT DOCUMENTS

| | | | | |
|---|---|---|---|---|
| 7,669,353 | B2 * | 3/2010 | Schmeichel | E01H 5/06 172/817 |
| 7,676,962 | B2 * | 3/2010 | Schmeichel | E01H 5/06 172/811 |
| 7,703,222 | B2 * | 4/2010 | Schmeichel | E01H 5/061 172/811 |
| 7,707,753 | B2 * | 5/2010 | Schmeichel | E01H 5/06 172/811 |
| 7,735,245 | B2 * | 6/2010 | Schmeichel | E01H 5/06 172/811 |
| 8,793,906 | B2 * | 8/2014 | Warchola | E01H 5/061 37/231 |
| 9,051,716 | B2 | 6/2015 | Bricker et al. | |
| 2014/0271078 | A1 | 9/2014 | Koch | |

* cited by examiner

VERTICALLY ADJUSTABLE ADAPTOR FOR A WORK VEHICLE IMPLEMENT

BACKGROUND

The disclosure relates generally to a vertically adjustable adaptor for a work vehicle implement.

Certain work vehicles (e.g., tractors, skid steers, etc.) include a cab configured to house an operator and a chassis configured to support the cab. The chassis is also configured to support wheels and/or tracks to facilitate movement of the work vehicle relative to a ground surface. In addition, various mechanical components of the work vehicle, such as a motor, a transmission, and a hydraulic system, among other components, may be supported by the chassis and/or disposed within an interior of the chassis. Certain work vehicles (e.g., skid steers) have an arm rotatably coupled to the chassis and configured to support an implement (e.g., dozer blade, grapple, etc.). For example, the arm may support a dozer blade to facilitate earth-moving operations. Accordingly, the horizontal forces experienced by the dozer blade are transmitted through the arm to the chassis via an arm pivot joint. However, the maximum force rating of the dozer blade may be limited due to a maximum horizontal force rating of the arm. Therefore, to support a greater horizontal load, the arm may be supported by the chassis of the work vehicle while the arm is in a lowered position, or the dozer blade may be non-movably coupled directly to the chassis of the work vehicle. Unfortunately, in such configurations, the dozer blade cannot move in a vertical direction while experiencing the greater horizontal load.

BRIEF DESCRIPTION

In one embodiment, an adaptor configured to move a work vehicle implement includes a work vehicle portion that includes a first receiver interface configured to couple to a work vehicle. The first receiver interface includes at least one receiver locking feature configured to non-movably couple the work vehicle portion to the first connector interface. The adaptor also includes a work implement portion moveably coupled to the work vehicle portion. The work implement portion includes a second connector interface configured to couple to a corresponding second receiver interface of the work vehicle implement, and the second connector interface comprises at least one connector locking feature configured to non-movably couple the work implement portion to the second receiver interface. The adaptor also includes a track system comprising a slot disposed within the work vehicle portion and a slider disposed on the work implement portion, wherein the slider is configured to move along the slot, and at least one actuator configured to actuate the work implement portion with respect to the work vehicle portion along a guide path.

In another embodiment, a system for actuating a work vehicle implement, including a work vehicle arm. The system also includes a work vehicle member configured to support the work vehicle arm while the work vehicle arm is in a lowered position. Moreover, the system also includes a first connector interface coupled to the work vehicle arm. Further, the system includes an actuatable adaptor having a work vehicle portion that includes a first receiver interface configured to couple the first connector interface. The first receiver interface includes at least one receiver locking feature configured to non-movably couple the work vehicle portion to the first connector interface. The adaptor further includes a work implement portion moveably coupled to the work vehicle portion. The work implement portion includes a second connector interface configured to couple to a second receiver interface of the work vehicle implement. The second connector interface includes at least one connector locking feature configured to non-movably couple the work implement portion to the second receiver interface. The adaptor further includes at least one actuator configured to actuate the work implement attachment with respect to the work vehicle mounting portion along a guide path.

In a further embodiment, a system for actuating a work vehicle implement, including a work vehicle arm. The system also includes a first connector interface coupled to the work vehicle arm. Further, the system includes an actuatable adaptor having a work vehicle portion that includes a first receiver interface configured to couple the first connector interface. The first receiver interface includes at least one receiver locking feature configured to non-movably couple the work vehicle portion to the first connector interface. The adaptor further includes a work implement portion moveably coupled to the work vehicle portion. The work implement portion includes a second connector interface configured to couple to a second receiver interface of the work vehicle implement. The second connector interface includes at least one connector locking feature configured to non-movably couple the work implement portion to the second receiver interface. Moreover, the system further includes a control system having a processor and a memory. The control system is configured to block at least one arm actuator from raising the work vehicle arm if the first receiver interface of the actuatable adaptor is coupled to the first connector interface of the work vehicle, or block the at least one actuator of the actuatable adaptor from extending if the work vehicle arm is raised from a lowered position.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1A:
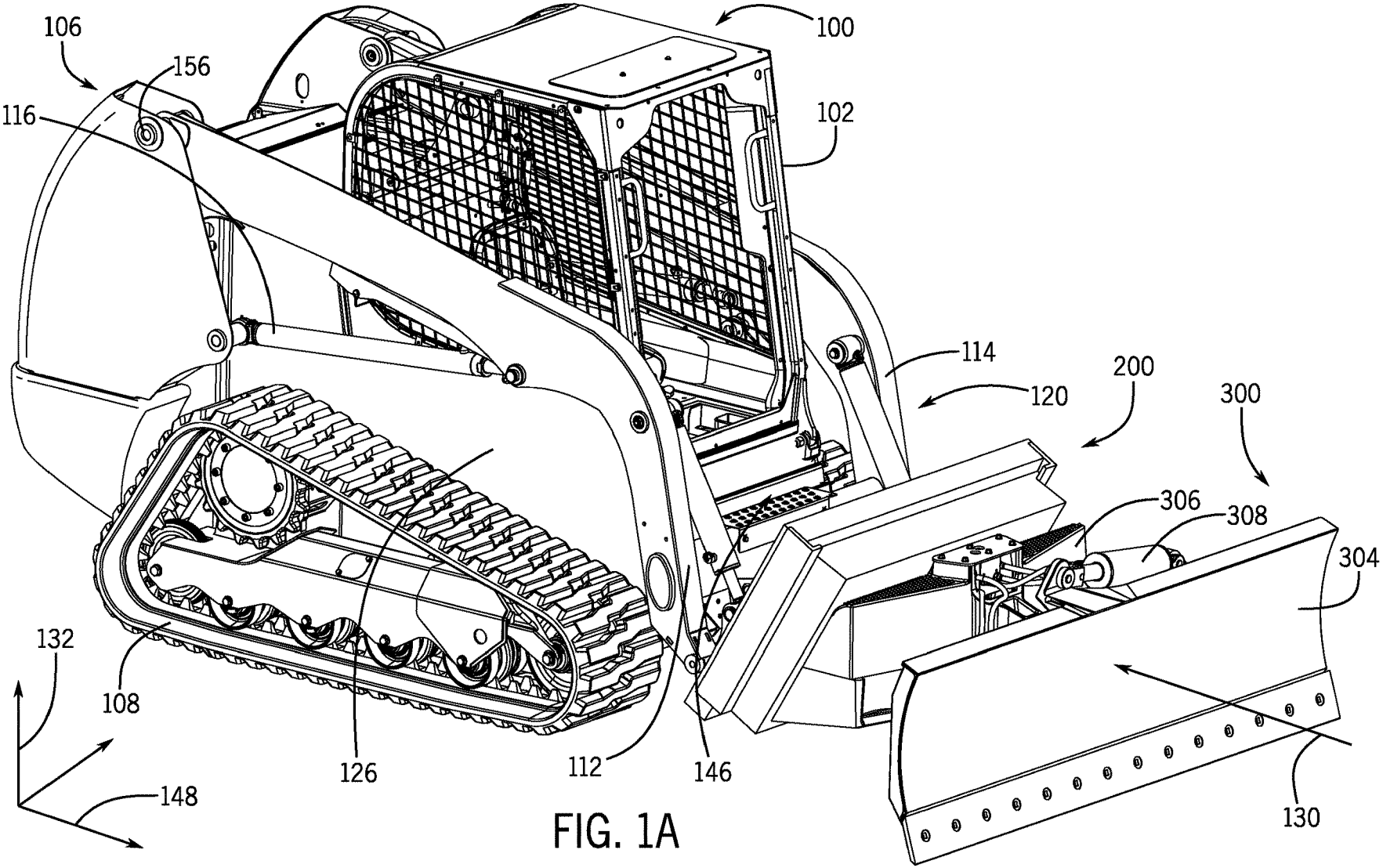
FIG. 1A is a perspective view of an embodiment of a work vehicle and a work vehicle implement coupled to the work vehicle by an adaptor.

FIG. 1A is a perspective view of an embodiment of a work vehicle 100 and a work vehicle implement 300 (e.g., a dozer blade) coupled to the work vehicle 100 by an adaptor 200. In the illustrated embodiment, the work vehicle 100 is a skid steer. However, it should be appreciated that the work vehicle may be any suitable type of work vehicle, such as a tractor, dozer, etc. In the illustrated embodiment, the work vehicle 100 includes a cab 102, a chassis 126, and an arm assembly 106. In certain embodiments, the chassis is configured to house a motor (e.g., diesel engine, etc.), a hydraulic system (e.g., including a pump, valves, a reservoir, etc.), and other components (e.g., an electrical system, a cooling system, etc.) that facilitate operation of the work vehicle. In addition, the chassis is configured to support the cab 102 and tracks 108. The tracks 108 may be driven to rotate by the motor and/or by component(s) of the hydraulic system (e.g., hydraulic motor(s), etc.). While the illustrated work vehicle 100 includes tracks, it should be appreciated that in alternative embodiments, the work vehicle may include wheels or a combination of wheels and tracks 108.

The cab 102 is configured to house an operator of the work vehicle 100. Accordingly, various controls, such as a hand controller, are positioned within the cab 102 to facilitate operator control of the work vehicle 100. For example, the controls may enable the operator to control the rotational speed of the tracks, thereby facilitating adjustment of the speed and/or the direction of the work vehicle 100. In certain embodiments, the cab may include a door to facilitate ingress and egress of the operator from the cab.

In the illustrated embodiment, the arm assembly 106 is configured to couple to the adaptor 200 and to support a load on the work vehicle implement 300. The arm assembly 106 has a first arm 112 and a second arm 114 each rotatably coupled to the chassis 126 by a respective pivot joint 156 and configured to couple to the adaptor 200. The arm assembly 106 includes at least one arm actuator 116 configured to extend and retract to control the position of the first and second arms 112, 114 (e.g., raise, lower, etc.). Additionally, the arm assembly 106 includes a tilt assembly configured to control rotation of the adaptor 200. In some embodiments, the work vehicle implement 300 includes the tilt assembly 306 coupled to the adaptor 200. The tilt assembly 306 includes a hydraulic cylinder 308 configured to drive rotation of the work implement. Furthermore, it is to be understood that the term "arm assembly" as generally used here not only refers to the first and second arms, but also to an input device or devices (e.g., one or more hand controllers, levers, etc.) and other components sufficient to facilitate operation of the arms, such as pump(s), hose(s), valve(s), fitting(s), hydraulic cylinder(s), hardware, and so forth.

In the illustrated embodiment, arms of the arm assembly 106 are movable between a lowered position 120 and a raised position. While in a lowered position, the arms are supported so the dozer blade can support a larger horizontal load.

The work vehicle may include mechanical stops to support the arms of the arm assembly 106 while the arms are in the lowered position. The mechanical stops transfer a portion of the load from the arm assembly 106 to the work vehicle chassis 126, thereby enabling the arm assembly to support a larger horizontal load. To support the arms of the arm assembly 106, the mechanical stops contact the arms while the arms are in the lowered position. The mechanical stops are attached to the chassis 126 of the work vehicle 100 on a lower front portion of the chassis 126. The mechanical stops are configured to contact a portion of each arm of the arm assembly 106 that is positioned proximate the lower front portion of the chassis 126. Thus, the mechanical stops are configured to support the arms of the arm assembly 106 while the arms are in the lowered position 120. In some embodiments, a single mechanical stop may support both the first and the second arms of the arm assembly 106.

Because the mechanical stops support the arms of the arm assembly 106 while the arms are in the lowered position 120, the dozer blade may support heavy loads while the arms are in the lowered position 120. While the work vehicle implement is a dozer blade in this embodiment, the work vehicle implement could be other suitable work vehicle implements. To enable the dozer blade to move in a vertical direction 132 while the arms are in the lowered position, an adaptor 200, which couples the dozer blade to the arm assembly 106, may drive the dozer blade to move in the vertical direction.

In some embodiments, the adaptor is coupled directly to the work vehicle chassis 126, thereby, obviating the mechanical stops. Loads on the work vehicle implement 300 are transferred from the work vehicle implement to the arms of the arm assembly 106 via the adaptor 200. The mechanical stops are configured to extend out from the chassis to engage the arms of the arm assembly such that loads on the arms are transferred from the arms to the chassis 126 via the mechanical stops. When the adaptor is coupled to the work vehicle, loads on the work implement are transferred from the work vehicle implement directly to the chassis via the adaptor, thereby obviating the mechanical stops.

Figure 1B:
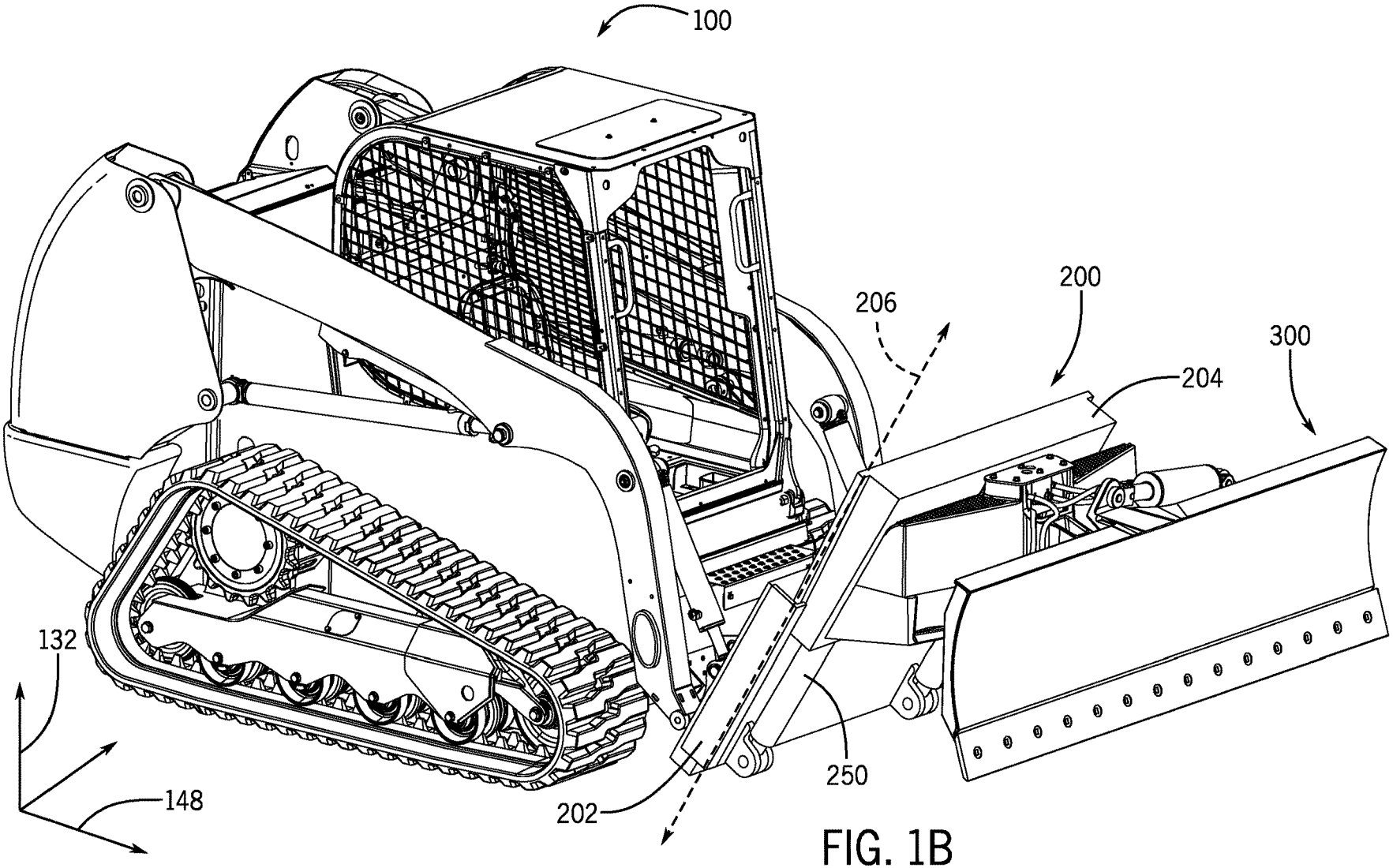
FIG. 1B is a perspective view of the work vehicle and the work vehicle implement of FIG. 1A, in which the work vehicle implement is in a raised position.

FIG. 1B is a perspective view of the work vehicle 100 and the work vehicle implement 300 of FIG. 1A, in which the work vehicle implement is in a raised position. In the illustrated embodiment, the adaptor 200 is configured to move the work vehicle implement 300 (e.g., a dozer blade) with respect to the work vehicle. In some embodiments, the adaptor 200 is configured to move the work vehicle implement 300 in a substantially vertical direction 132. The adaptor 200 includes a work vehicle portion 202, an implement portion 204 moveably attached to the work vehicle portion, and a pair of actuators 250 configured to move the work implement portion 204 of the adaptor 200 with respect to the work vehicle portion 202 of the adaptor 200. In some embodiments, the adaptor includes a single actuator, however, in other embodiments, the adaptor includes a plurality of actuators. In some embodiments, the pair of actuators 250 move the work implement portion 204 with respect to the work vehicle portion 202 along a substantially linear guide path 206, which is oriented at an angle relative to the vertical axis 132 and the longitudinal axis 148. The angle between the vertical axis and the substantially linear guide path is less than forty-five degrees.

Figure 1C:
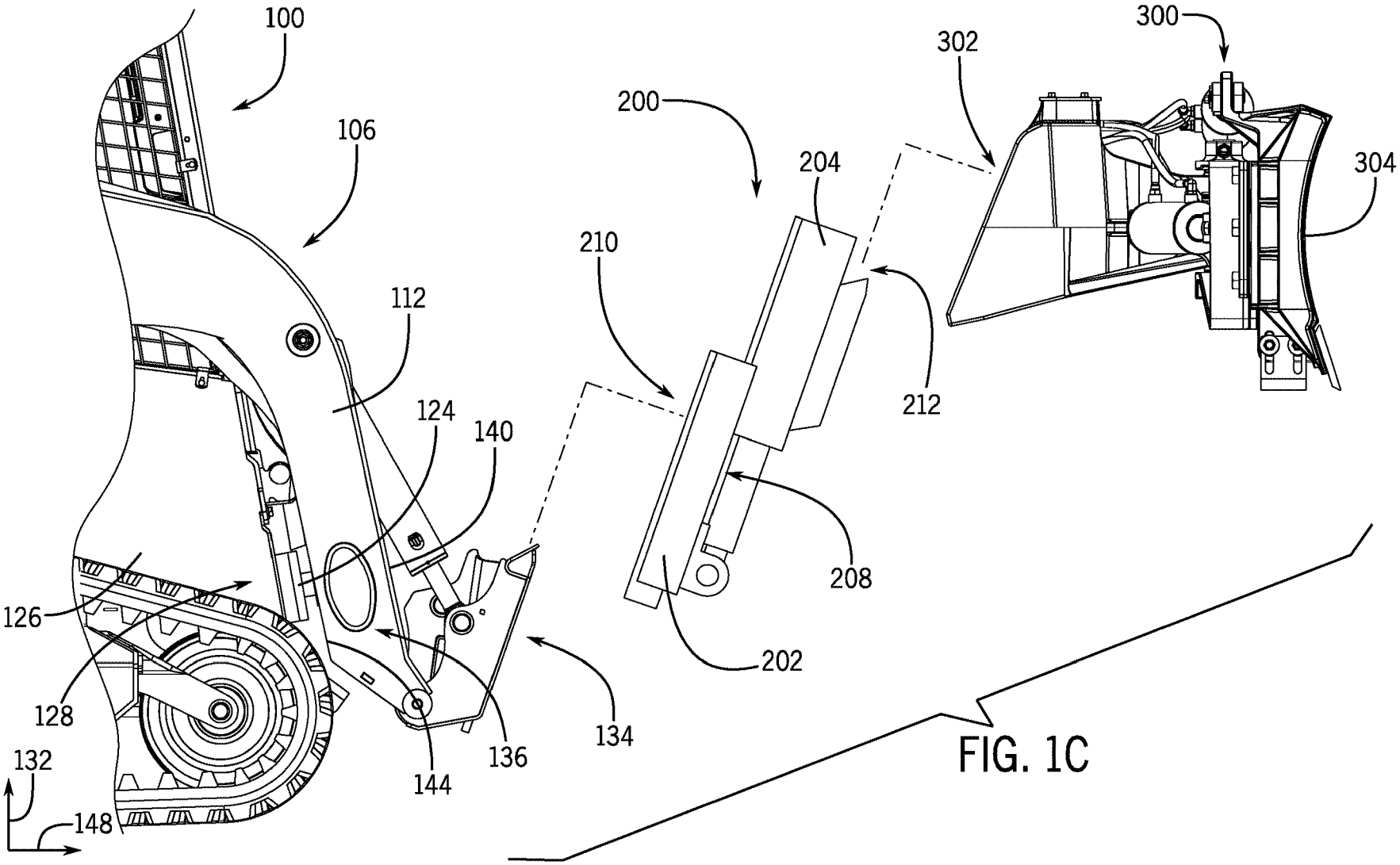
FIG. 1C is an exploded view of the work vehicle, the adaptor, and the work vehicle implement of FIG. 1A.

FIG. 1C is an exploded view of the work vehicle 100, the adaptor 200, and the work vehicle implement 300 of FIG. 1A. The adaptor 200 includes the work vehicle portion 202 and work implement portion 204 connected at a moveable interface 208. In the illustrated embodiment, the work vehicle portion 202 of the adaptor includes a first receiver interface 210 configured to couple to a first connector interface 134 of the work vehicle 100. In some embodiments, the arm assembly 106 may include the first connector interface 134. For example, the first connector interface 134 may be disposed on the arms of the arm assembly 106 proximate a lower portion 136 of the arm assembly 106 such that the adaptor 200 may be coupled to the work vehicle in a position proximate to the ground. Further, the first connector interface 134 is disposed on an outer portion 140 of the arm assembly 106 proximate the lower portion 136 (e.g., the portion of the arm assembly 106 opposite the portion facing the chassis). In some embodiments, the first connector interface 134 is connected to the first arm 112 and/or the second arm 114 of the arm assembly 106. In some embodiments, the first connector interface 134 may be coupled to a mounting plate. The mounting plate may be coupled to the arm assembly 106 at the outer portion 140 or the arm assembly 106. However, the mounting portion may be coupled to the arm assembly 106 from a position between the first and second arms of the arm assembly 106, and in some embodiments, the mounting plate may be couple to an inner portion 144 of the arm assembly 106. Additionally, the mounting plate may be removable. The mounting plate is configured to provide additional mounting options for coupling the first connector interface to the work vehicle.

In another embodiment, the first connector interface 134 is coupled to the chassis 126 of the work vehicle 100. The first connector interface 134 may be disposed on a lower front portion 128 of the chassis 126 such that the adaptor 200 may be coupled to the work vehicle in a position proximate to the ground. Additionally, the first connector interface 134 may be disposed on a central portion 146 of the chassis 126 to direct the load from the work vehicle implement 300 along the centerline of the work vehicle. Additionally, the load experienced by the work vehicle implement 300 may transfer to chassis 126 at the location of the first connector interface 134. In some cases, the work vehicle may not be capable of supporting heavy loads. The work vehicle may include at least one support element configured to support portions of the work vehicle at the first connector interface 134. The support element may be a reinforcement strut configured to distribute a portion of the load to another portion of the work vehicle. In an embodiment having the first connector interface disposed on the arms of the arm assembly, the support elements may be configured to support the work vehicle at a location of the mechanical stops 124. In some embodiments, the support element may include reinforced plating disposed proximate the first connector interface 134. In another embodiment, the first connector interface 134 may be disposed on a front portion of the chassis of the work vehicle.

In the illustrated embodiment, the work implement portion 204 of the adaptor 200 includes a second connector interface 212 configured to couple to a second receiver interface 302 of the work vehicle implement 300. The work vehicle implement 300 may be a dozer blade, bale spear, etc. having a working face 304 configured to contact the work material (e.g., soil, debris, etc.). The second receiver interface 302 may be disposed on a portion of the work vehicle implement 300 opposite the working face 304.

In some embodiments, the first receiver interface 210 of the work vehicle portion 202 of the adaptor 200 is substantially similar to the second receiver interface 302 of the work vehicle implement 300, and the first connector interface 134 of the work vehicle arm is substantially similar to the second connector interface 212 of the work implement portion 204 of the adaptor 200. Therefore, the first connector interface 134 may be configured to attach to either the first receiver interface 210 of the adaptor 200 or to the second receiver interface 302 of the work vehicle implement 300. In some cases, an operator may choose to remove the adaptor 200 when using a tool that is not expected to experience large horizontal loads or when vertical movement of the dozer blade is not needed. In these cases, the operator may attach the first connector interface 134 of the work vehicle directly to the second receiver interface 302 of the work vehicle implement 300.

Figure 2A:
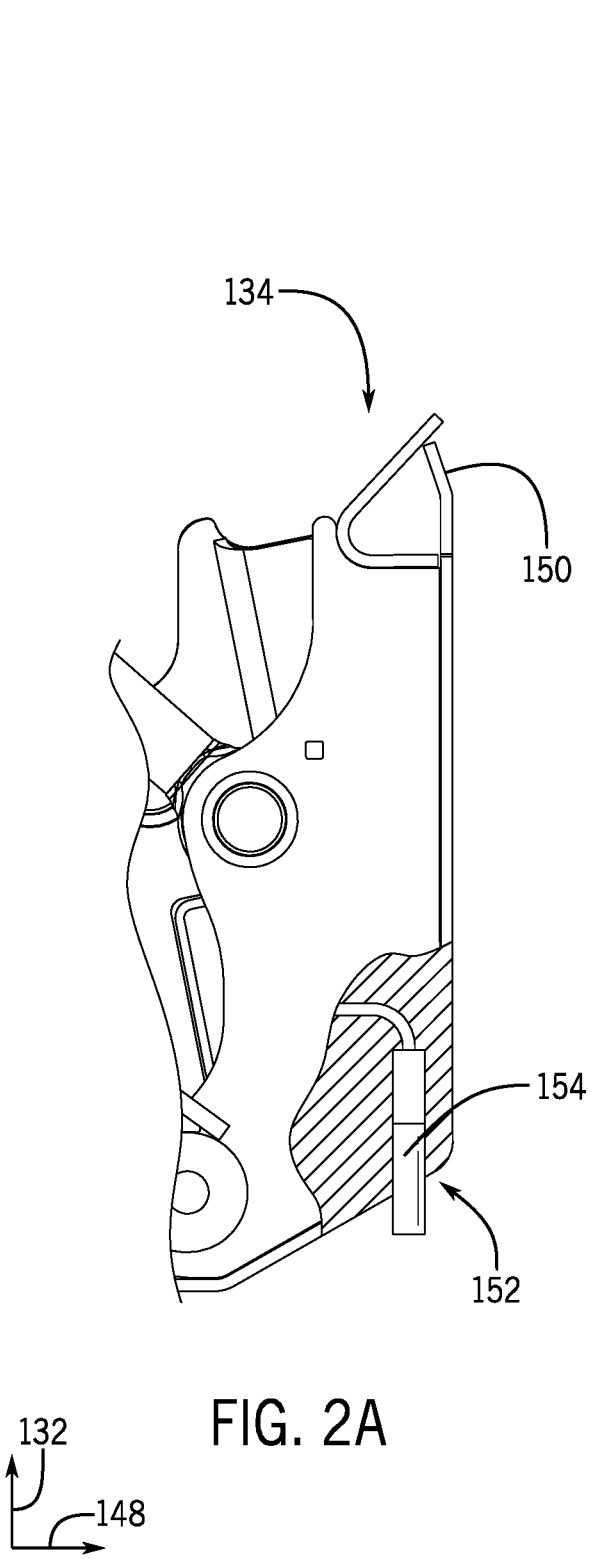
FIG. 2A is a cross-sectional view of a connector interface of the work vehicle of FIG. 1A.

FIG. 2A is a cross-sectional view of the connector interface 134 of the work vehicle 100 of FIG. 1A. In the illustrated embodiment, the first connector interface 134 includes a connector interface feature 150. The connector interface feature 150 includes a protrusion. However, the connector interface may include a lip, tongue, ridge, or another suitable feature. The protrusion may be configured to engage a corresponding receiver interface feature 214 to block movement of the receiver interface with respect to the connector interface in at least a downward direction of the adaptor along the vertical axis 132. In some embodiments, the protrusion is configured to fit within an opening 260 of the receiver interface feature 214. As part of coupling the connector interface 134 to the receiver interface 210, the protrusion may be configured to slide into the opening 260. The contact between the protrusion and the opening blocks movement of the connector interface 134 with respect to the receiver interface 210 in multiple directions. For example, if the protrusion slides into the opening 260 substantially along a horizontal axis 148, then the contact between the protrusion and the recess 260 may block movement of the protrusion and the connector interface axis, except for the horizontal axis 148, with respect to the receiver interface. The above example illustrates a restrictive fit between a protrusion and a recess 260, however, by the same principle, contact between other connector interface feature 150 and receiver interface feature 214 similarly block movement.

The first connector interface includes at least one connector locking feature 152 configured to enable coupling of the first connector interface 134 to the first receiver interface 210. For example, the first connector interface 134 may include at least one connector locking feature 152 configured to enable coupling the work vehicle 100 to the work vehicle portion 202 of the adaptor 200.

As discussed above, the connector interface feature 150 and the receiver interface feature 214 are configured to block movement in multiple directions. However, the connector interface feature and the receiver interface feature may not block movement along the horizontal axis 148 proximate a bottom portion of the first receiver interface 210. The connector locking feature 152 may be configured to couple to the receiver locking feature 220 to block movement along the horizontal axis 148 at the bottom portion of the first receiver interface. The at least one connector locking feature is configured to the receiver locking feature to block movement the connector interface 134 and the receiver interface 210 from separating.

The connector locking feature 152 may include an actuatable member 154 configured to engage with a corresponding receiver locking feature 220 of the work implement. As discussed above, in some embodiments, the receiver locking feature 220 may have a similar shape and size as the connector locking feature with the actuatable member extended to allow for actuation of the connector locking feature 152 within the receiver locking feature 220. The connector locking feature 152 is configured to fit within the receiver locking feature 220. In some embodiments, the connector locking feature 152 is configured to move into the receiver locking feature 220 along a first direction. Once the connector locking feature moves into the receiver locking feature 220, the actuatable member 154 is configured to expand or extend out from the connector locking feature 152 into a portion of the receiver locking feature 220 to block movement of the connector interface and the receiver interface along the first direction.

In some embodiments, the connector locking feature 152 is configured to actuate from a position within the connector interface to a position protruding from connector interface. In some embodiments, the connector locking feature 152 is configured to actuate downwardly along the axis 132, which is in a direction toward the ground. However, the connector locking feature 152 may be configured to actuate from the connector interface in any suitable direction.

The connector locking feature 152 may be configured to actuate by extending the actuatable member 154 to a locked position. The connector locking feature 152 is configured to actuate between a locked position and an unlocked position to facilitate a detachable connection between the first receiver interface 210 and the first connector interface 134.

Figure 2B:
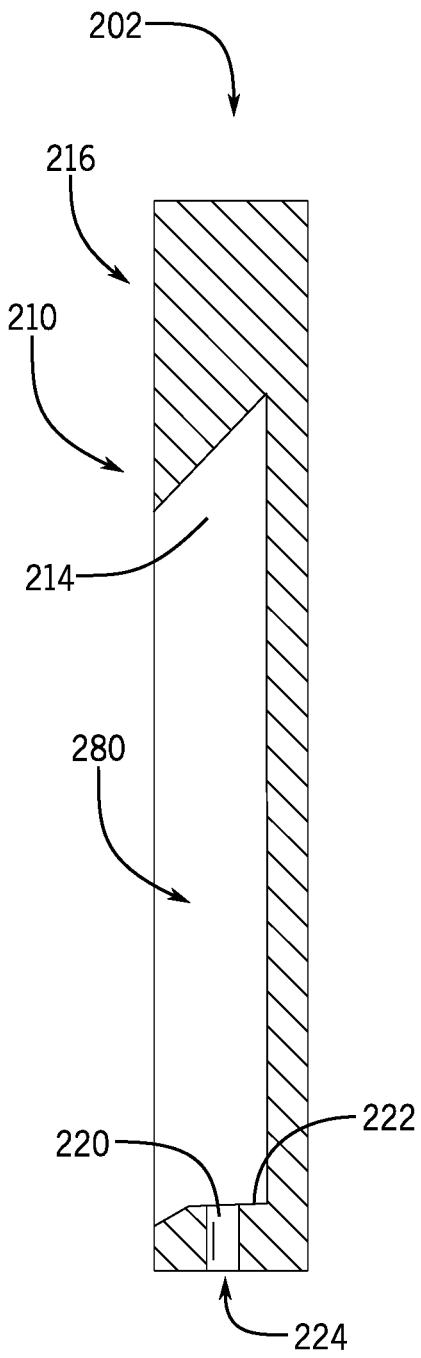
FIG. 2B is a cross-sectional view of a receiver interface of the adaptor of FIG. 1A.

FIG. 2B is a cross-sectional view of the first receiver interface 210 of the adaptor 200 of FIG. 1A. In the illustrated embodiment, the first receiver interface 210 includes a cavity 280 and the receiver interface feature 214. The receiver interface feature 214 may include a groove, recess, opening, or a combination thereof. In some embodiments, the receiver interface feature 214 includes multiple grooves, recesses, openings, or some combination thereof. In the illustrated embodiment, the receiver interface feature 214 is disposed proximate a top portion 216 of the cavity. However, the receiver interface feature 214 may be disposed on any suitable portion of the receiver interface.

In some embodiments, the receiver interface feature 214 is configured to receive the corresponding connector interface feature 150. The shape and size of the receiver interface feature 214 and the corresponding connector interface feature 150 substantially match to block movement of the receiver interface with respect to the connector interface in at least a downward direction of the adaptor substantially along the vertical axis 132. For example, the receiver interface feature 214 includes a groove disposed proximate a top portion 216 of the cavity 280. The corresponding connector interface includes a tongue. The groove may be configured to receive the tongue such that the tongue enters the groove while moving upwardly substantially along the vertical axis 132. Once the tongue fully engages the groove, the tongue blocks the adaptor 200 from moving downwardly substantially along the vertical axis 132. Additionally, preventing movement via a restrictive fit may provide structural support for at the connector and receiver interfaces.

In some embodiments, the receiver interface feature 214 may block movement of the receiver interface with respect to the connector interface in multiple directions. Blocking movement in a plurality of directions via a restrictive fit between the first connector interface 134 and the first receiver interface 210 may provide additional structural support for at the connector and receiver interfaces.

In some embodiments, the first receiver interface 210 comprises at least one receiver locking feature 220 configured to enable coupling of the first receiver interface 210 to the first connector interface 134. The receiver locking feature 220 is configured to receive the corresponding connector locking feature 152 of the first connector interface 134 to substantially block movement in at least a horizontal direction 148. The receiver locking feature 220 includes an opening 260. However, the receiver locking feature includes a recess, bore, or another suitable feature. In some embodiments, the opening may have a non-constant width or diameter along the depth of the opening. For example, the opening 260 of the first receiver interface 210 includes the opening 260 beginning at a surface 222 of the first receiver interface 210 that extends into the body of the work vehicle portion 202 of the adaptor 200. At some depth the opening 260 may increase its diameter or width to match the shape or size of a corresponding connector locking feature 152. In some embodiments, the opening 260 may comprise an elbow that changes directions of the recess 260. The elbow may change a direction of the recess 260 by ninety degrees. In other embodiments, the elbow may change the direction of the recess 260 by substantially more or less than ninety degrees. The connector locking feature may be configured to extend the actuatable member 154 at the elbow of the opening.

In some embodiments, the receiver locking feature 220 includes a bore 224 in a portion of the receiver interface. The bore extends completely through a portion of the receiver interface. The bore may have a circular cross section. However, the cross section of the bore may take any suitable shape (e.g., a rectangular cross section). In some embodiments, the receiver interface 210 comprises a plurality of bores. The actuatable member 154 of the connector locking feature 152 is configured to extend into the bore to block movement of the adaptor 200 away from the first connector interface 134.

Figure 3A:
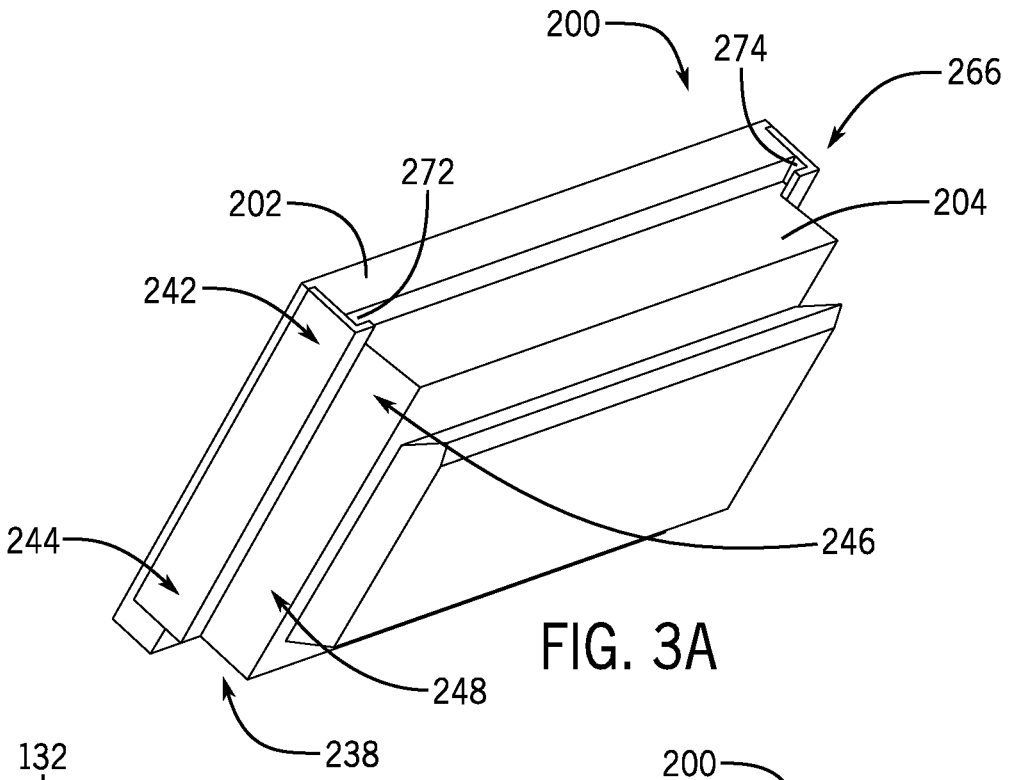
FIG. 3A is a perspective view of the adaptor of FIG. 1A in a non-extended position.

FIG. 3A is a perspective view of the adaptor 200 of FIG. 1A in a fully retracted position 238. The work vehicle portion 202 of the adaptor 200 includes a top section 242 and bottom section 244. Further, the work implement portion 204 of the adaptor 200 includes a top section 246 and bottom section 248. The adaptor 200 is configured to move the work implement portion 204 in a substantially vertical direction 132 with respect to the work vehicle portion 202 of the adaptor 200. The adaptor 200 is configured to move the work implement portion 204 between the fully retracted position 238 and a fully extended position 240. In the fully retracted position 238, the bottom section 244 of the work vehicle portion 202 and the bottom section 248 of the work implement portion 204 are substantially vertically aligned. Furthermore, in the retracted position, the bottom sections are disposed proximate the ground.

Figure 3B:
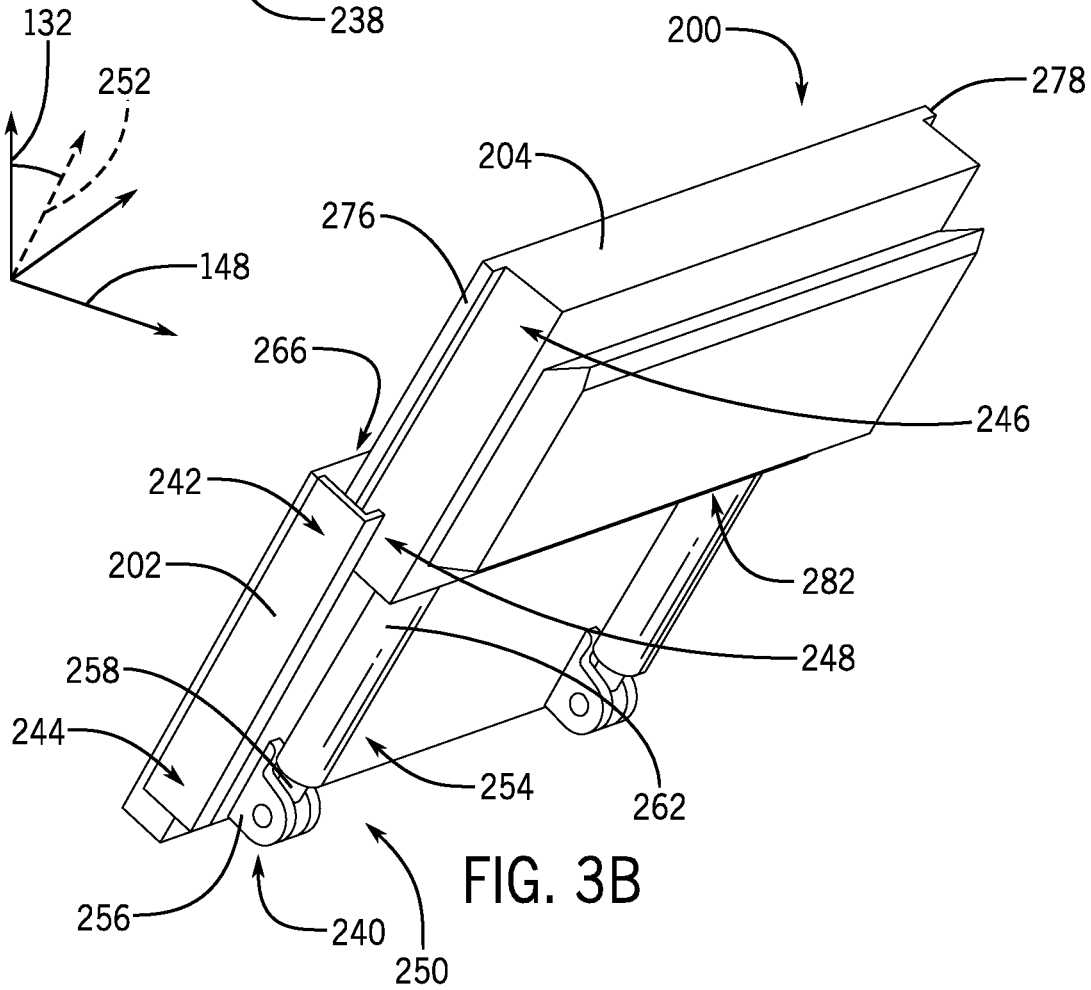
FIG. 3B is a perspective view of the adaptor of FIG. 1A in an extended position.

FIG. 3B is a perspective view of the adaptor 200 of FIG. 1A in a fully extended position 240. The adaptor 200 moves the work implement portion 204 vertically upward with respect to the work vehicle portion 202 to transition from the fully retracted position 238 to the fully extended position 240. The work vehicle portion 202 remains substantially stationary with respect to the work vehicle arm as the adaptor 200 transitions to the fully extended position 240. Thus, in the fully extended position 240, the bottom section 248 of the work implement portion 204 may be substantially vertically aligned with the top section 242 of the work vehicle portion 202. Further, the work vehicle portion 202 remains disposed proximate the ground. However, the work implement portion 204 is raised up from the ground when the adaptor 200 is in the fully extended position 240.

In some embodiments, the adaptor 200 includes a pair of actuators 250 configured to move the work implement portion 204 from the fully retracted position 238 to the fully extended position 240. The actuators 250 may be a linear actuators. The actuators 250 may drive the work implement portion 204 to move substantially along the vertical axis 132. However, in some embodiments, the actuators 250 may move the work implement portion 204 in a vertically offset direction 252 having an angle offset from the vertical axis 132. In some embodiments, the actuators 250 comprise at least one hydraulic cylinder, pneumatic cylinder, electric cylinder, manual cylinder, or a combination thereof.

The actuators 250 include a piston assembly 254 having a base 256, a piston 258, and piston cylinder 262. In some embodiments, the base 256 is coupled to the work vehicle portion 202 of the adaptor 200 proximate the bottom section 244 of the work vehicle portion 202. Attaching the base 256 proximate the bottom section 244 enables the bottom section 248 of the work implement portion 204 to retract to a position proximate the bottom section 244 of the work vehicle portion 202. The piston cylinder 262 may be configured to attach to the work implement portion 204 proximate a top section 246 of the work implement portion 204. In an embodiment with a hydraulic actuator, the work implement portion 204 includes a recess 282 extending from the bottom section to the top section 246 of the work implement portion 204. The recess is configured to accommodate the piston cylinder 262. The piston cylinder is configured to slide into the recess 282 and attach mount to the work implement portion proximate the top section 246. A hydraulic system may be connected to a portion of the recess 282 to hydraulically actuate the piston cylinder 262 to extend and retract the work implement portion with respect to the work vehicle portion between the fully extended position 240 and fully retracted position 238. However, the piston cylinder may be configured to move the work implement portion with respect to the work vehicle portion to a position between the fully extended position and the fully retracted position.

In some embodiments, the adaptor 200 includes a track system 266 configured to movably attach the work implement portion 204 to the work vehicle portion 202. Further, the track system 266 is configured to substantially block movement of the work implement portion 204 with respect to the work vehicle portion 202 in a direction perpendicular to a guide path. As such, the track system 266 is configured restrain movement of the adaptor 200 to the guide path between the retracted position and extended position. In some embodiments, the actuators 250 are aligned with the guide path such that the track system 266 limits movement of the work implement portion 204 to a direction of actuation of the actuators 250.

The track system 266 includes at least one slot disposed in the work vehicle portion 202. In the illustrated embodiment, the work vehicle portion 202 includes two slots that extend from the bottom section 244 to the top section 242. A right slot 272 is disposed on a right side of the work vehicle portion 202, and a left slot 274 is disposed on a left side of the work vehicle portion 202. The track system 266 further includes at least one slider configured to move along the at least one slot as the actuators 250 extend and retract. In the illustrated embodiment, the work implement portion 204 includes two sliders extending from the bottom section 248 to the top section 246. A right slider 276 is disposed on a right side of the work implement portion 204, and a left slider 278 is disposed on a left side of the work implement portion 204. The left slider 278 is configured to be disposed in the left slot 274, and the right slider 276 is configured to fit in the right slot 272. As the actuators 250 extend and retract, the left slider 278 and the right slider 276 slide along the left slot 274 and right slot 272 respectively. In some embodiments, work vehicle portion includes sliders, and the work implement portion includes slots.

Figure 4:
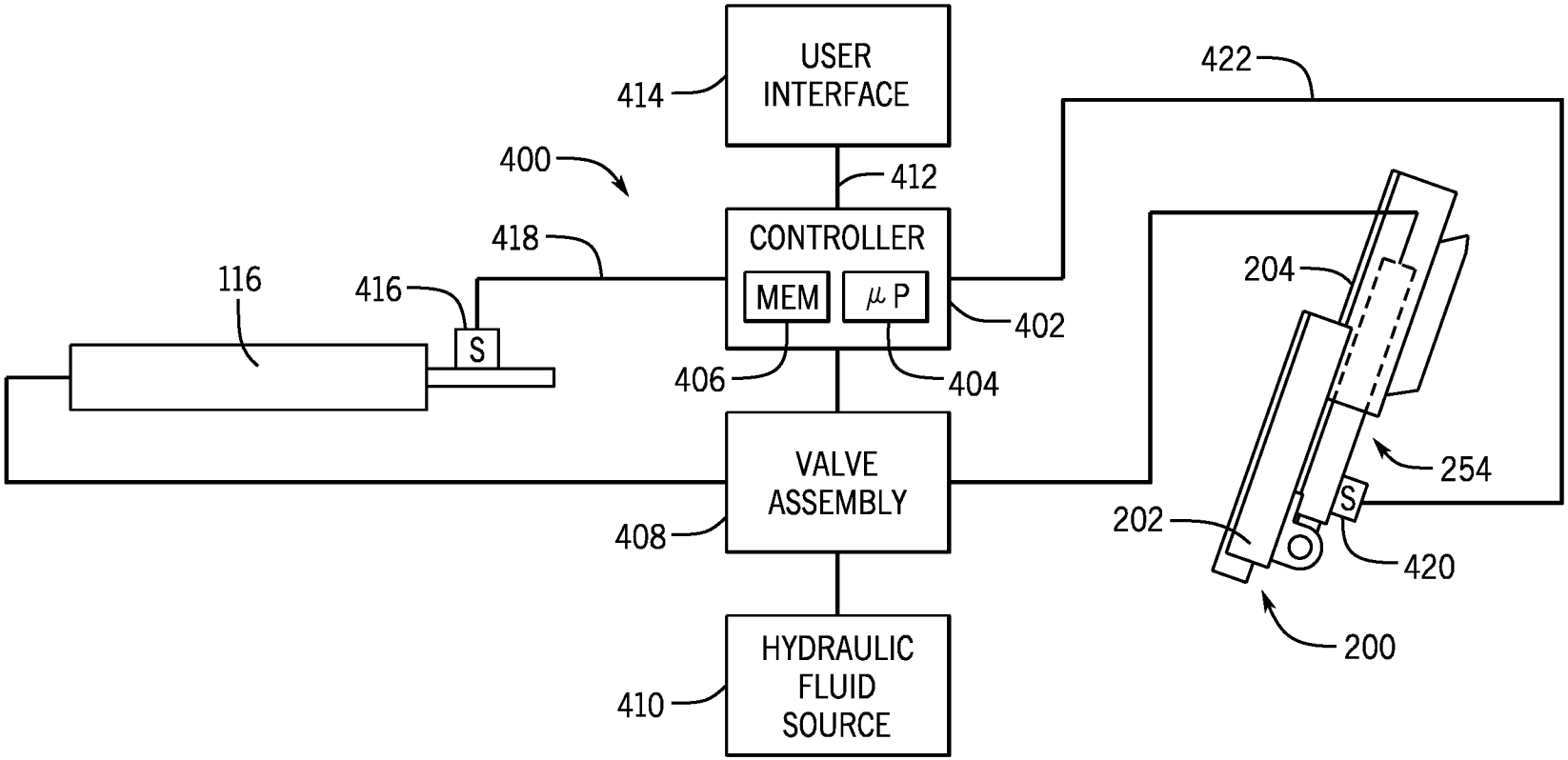
FIG. 4 is a block diagram of a control system for the work vehicle and adaptor of FIG. 1A.

FIG. 4 is a block diagram of an embodiment of a control system 400 that may be employed within the work vehicle of FIG. 1A. The control system includes a controller 402 having a processor, such as the illustrated microprocessor 404, and a memory device 406. The controller 402 may also include one or more storage devices and/or other suitable components. Moreover, the processor 404 may include multiple microprocessors, one or more "general-purpose" microprocessors, one or more special-purpose microprocessors, and/or one or more application specific integrated circuits (ASICS), or some combination thereof. For example, the processor 404 may include one or more reduced instruction set (RISC) processors.

The memory device 406 may include a volatile memory, such as random access memory (RAM), and/or a nonvolatile memory, such as read-only memory (ROM). The memory device 406 may store a variety of information and may be used for various purposes. For example, the memory device 406 may store processor-executable instructions (e.g., firmware or software) for the processor 404 to execute. The storage device(s) (e.g., nonvolatile storage) may include ROM, flash memory, a hard drive, or any other suitable optical, magnetic, or solid-state storage medium, or a combination thereof. The storage device(s) may store data (e.g., position data, vehicle geometry data, etc.), instructions (e.g., software or firmware), and any other suitable data.

In certain embodiments, the controller 402 is configured to instruct a valve assembly 408 to control hydraulic fluid flow from a hydraulic fluid source 410 to the at least one arm actuator 116, which is configured to raise and lower the arms of the arm assembly. Additionally, the controller is configured to instruct the valve assembly 408 to control hydraulic fluid flow from the hydraulic fluid source to the adaptor piston assembly 254 to move the adaptor between the fully extended position and the fully retracted position, which respectively raises and lowers the work vehicle implement coupled to the adaptor. In some embodiments, the controller sends instructions to the valve assembly to move the at least one arm actuator and/or the adaptor piston assembly in response to a user input signal 412 received from a user interface 414. In other embodiments, the controller sends instructions based on instructions stored in the memory device.

In some embodiments, a work vehicle sensor 416 is disposed on the work vehicle. The work vehicle sensor is configured to measure a position of the arms of the arm assembly and output a work vehicle sensor signal 418 to the controller 402 indicating the position of the arms. An adaptor sensor 420 may be disposed on the adaptor 200. The adaptor sensor is configured to measure a position of the work implement portion 204 of the adaptor with respect to the work vehicle portion 202. The adaptor sensor may measure actuation of the piston assembly 254 to determine the position of the work implement portion 204 with respect to the work vehicle portion 202. Additionally, the adaptor sensor is configured to output an adaptor signal 422 to the controller indicating the position of the work implement portion of the adaptor with respect to the work vehicle portion.

In some embodiments, the control system 400 is configured to block the adaptor piston assembly 254 from extending to raise the work vehicle implement when the arms of the arm assembly are not in the fully lowered position. Thus, if the arms of the arm assembly are raised from the fully lowered position, then the controller 402 blocks actuation of the adaptor. For example, the controller, upon receiving the work vehicle sensor signal 418 indicating that the arms are not in the lowered position, may disregard user input signals 412 or instructions for the controller to cause the adaptor to raise the work vehicle implement. In some embodiments, the controller 402 is configured to automatically cause the adaptor 200 to retract to lower the work vehicle implement when the arms of the arm assembly are not in the fully lowered position.

In some embodiments, the controller 402 does not enable the arms of the arm assembly to move when the adaptor is coupled to the work vehicle. For Example, if the adaptor is attached and the arms of the arm assembly are in the fully lowered position, then the controller may block movement of the arms. Further, if the adaptor is attached and the arms are not in the fully lowered position, then the controller may move the arms to the fully lowered position. The controller may determine that the adaptor 200 is attached to the work vehicle when the controller receives the adaptor signal 422 from the adaptor sensor 420. In another embodiment, the controller is configured to block movement of the arms when the adaptor is not in the fully retracted position. The controller may be configured to block the adaptor from raising the work vehicle implement when the arms are raised, or the controller may block movement of the arms when the adaptor is attached or not in the fully retracted position, to reduce potential stress on the arms and/or pivot joint (e.g., because the arms are in contact with the mechanical stops while in the lowered position).

While only certain features have been illustrated and described herein, many modifications and changes will occur to those skilled in the art. For example, the work vehicle 100 may include the first receiver interface 210, and the adaptor 200 may include the first connector interface 134. Further, the adaptor may include the second receiver interface 302, and the work vehicle implement 300 may include the second connector interface 212. It is, therefore, to be understood that the appended claims are intended to cover all such modifications and changes as fall within the true spirit of the disclosure.

The invention claimed is:

1. An adaptor configured to move a work vehicle implement, comprising:

a work vehicle portion comprising a first receiver interface configured to couple to a corresponding first connector interface of a work vehicle, wherein the first receiver interface comprises at least one receiver locking feature configured to non-movably couple the work vehicle portion to the first connector interface;

a work implement portion moveably coupled to the work vehicle portion, wherein the work implement portion comprises a second connector interface configured to couple to a corresponding second receiver interface of the work vehicle implement, and the second connector interface comprises at least one connector locking feature configured to non-movably couple the work implement portion to the second receiver interface;

a track system comprising a slot disposed within the work vehicle portion and a slider disposed on the work implement portion, wherein the slider is configured to move along the slot; and at least one actuator configured to move the work implement portion with respect to the work vehicle portion along a guide path.

2. The system of claim 1, wherein the receiver locking feature comprises a recess, an opening, or a combination thereof, configured to receive a corresponding connector locking feature of the first connector interface.

3. The system of claim 1, wherein the connector locking feature comprises an actuatable member configured to engage a corresponding receiver locking feature of the second receiver interface.

4. The system of claim 1, wherein the first receiver interface comprises a receiver interface feature configured to engage a corresponding connector interface feature at the first connector interface to block movement of the first receiver interface with respect to the first connector interface in at least a substantially vertically down or longitudinal direction.

5. The system of claim 4, wherein the receiver interface feature comprises a groove, a recess, an opening, or a combination thereof.

6. The system of claim 1, wherein the first connector interface comprises a connector interface feature configured to engage a corresponding receiver interface feature at the connector interface feature to block movement of the first receiver connector interface with respect to the first receiver interface in a plurality of directions.

7. The system of claim 6, wherein the connector interface feature comprises a protrusion, a lip, a tongue, a ridge, or a combination thereof.

8. The system of claim 1, wherein the at least one actuator comprises a linear actuator.

9. The system of claim 8, wherein the linear actuator comprises a hydraulic cylinder.

10. The system of claim 1, wherein the track system is configured to block movement of the work implement portion with respect to the work vehicle portion in a direction substantially perpendicular to the slot.

* * * * *